US005082256A

United States Patent [19]

Bryson

[11] Patent Number: 5,082,256

[45] Date of Patent: Jan. 21, 1992

[54] METHOD AND APPARATUS FOR FORMING SHEET MATERIAL ASSEMBLAGES

[75] Inventor: Robert A. Bryson, Huber Heights, Ohio

[73] Assignee: AM International Incorporated, Chicago, Ill.

[21] Appl. No.: 134,085

[22] Filed: Dec. 17, 1987

[51] Int. Cl.[5] ..... B65H 5/30

[52] U.S. Cl. ..... 270/55; 270/54

[58] Field of Search ..... 270/54, 55, 57, 58; 271/9, 279, 285

[56] References Cited

U.S. PATENT DOCUMENTS

| | | | |
|---|---|---|---|
| 3,269,720 | 8/1966 | Schluckebier et al. | 270/57 |
| 4,477,067 | 10/1984 | Wise | 270/55 |
| 4,479,643 | 10/1984 | Seidel | 270/55 |
| 4,721,296 | 1/1988 | Mowry | 270/55 |

FOREIGN PATENT DOCUMENTS

| | | | |
|---|---|---|---|
| 414544 | 12/1966 | Switzerland | 270/54 |

*Primary Examiner*—Edward K. Look
*Assistant Examiner*—Therese M. Newholm
*Attorney, Agent, or Firm*—Tarolli, Sundheim & Covell

[57] ABSTRACT

Sheet material assemblages each having a jacket section enclosing a plurality of inner sections are formed by sequentially moving a circular array of upwardly opening pockets through an arcuate array of feed stations. A jacket section feed mechanism at a first one of the stations feeds a jacket section into each of the pockets in turn. A plurality of single inner section feed mechanisms feed inner sections one at a time into an open jacket section in each of the pockets in turn. A plural inner section feed mechanism is operable to feed a plurality of inner sections at a time into a jacket section in each of the pockets in turn.

8 Claims, 3 Drawing Sheets

METHOD AND APPARATUS FOR FORMING SHEET MATERIAL ASSEMBLAGES

BACKGROUND OF THE INVENTION

The present invention relates to a method and apparatus for forming a sheet material assemblage, such as a newspaper, having a jacket section enclosing a plurality of inner sections.

An apparatus for forming a sheet material assemblage having a jacket section enclosing a plurality of inner sections is disclosed in U.S. Pat. No. 4,479,643 issued Oct. 30, 1984 and entitled "Method and Apparatus for Transferring Newspapers From Pockets to an Overlapped Stream". The apparatus disclosed in this patent includes a plurality of stationary feed stations disposed in a circular array. Bottom opening pockets are sequentially moved through each of the feed stations.

A jacket feed mechanism is provided at a first one of the feed stations to feed a jacket into each of the pockets in turn as the pockets move through the first feed station. A plurality of inner section feed mechanisms are disposed at each of the other feed stations. Each of the inner section feed mechanisms is operable to feed inner sections one at a time into a jacket section in each of the pockets in turn. Since only one inner section is fed at a time into the jacket section at each of the feed stations, the maximum number of inner sections which can be fed into a jacket section is determined by the number of feed stations.

SUMMARY OF THE INVENTION

The present invention provides a new and improved method and apparatus for forming sheet material assemblages each of which has a jacket section enclosing a plurality of inner sections. To form the sheet material assemblages, each pocket in a circular array of pockets is sequentially moved through each feed station in an arcuate array of feed stations. At some of the feed stations, inner sections are fed one at a time into a jacket section in each of the pockets in turn. At another feed station, a plurality of inner sections are fed at a time into a jacket section in each of the pockets in turn. By feeding a plurality of inner sections at a time into a jacket section at one of the feed stations, the number of inner sections which can be fed into each jacket section can exceed the number of feed stations.

Accordingly, it is an object of this invention to provide a new and improved method and apparatus for forming sheet material assemblages having a jacket section enclosing a plurality of inner sections and wherein a plurality of inner sections are ıed at one time into a jacket section.

BRIEF DESCRIPTION OF THE DRAWINGS

The foregoing and other objects and features of the present invention will become apparent upon a consideration of the following description taken in connection with the accompanying drawings, in which.

DESCRIPTION OF ONE SPECIFIC PREFERRED EMBODIMENT OF THE INVENTION

Figure 1:
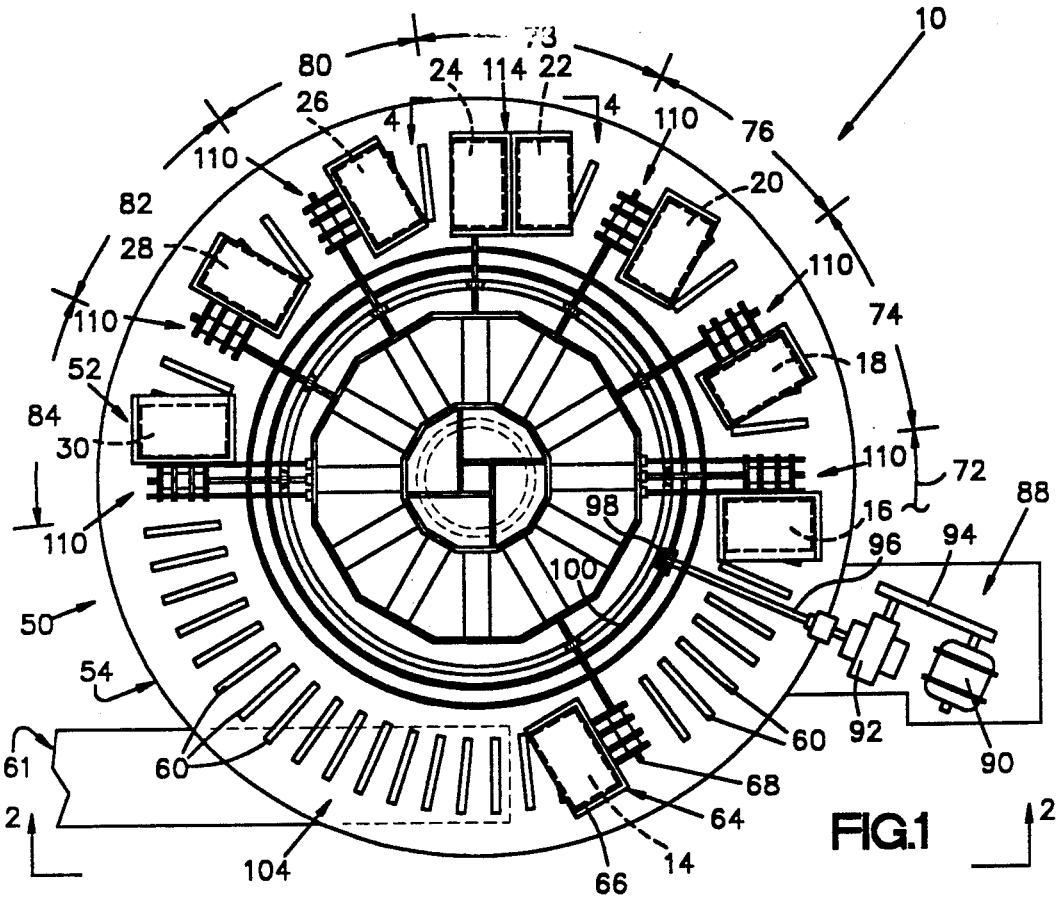
FIG. 1 is a plan view of an apparatus for use in forming sheet material assemblages each which has a jacket section enclosing a plurality of inner sections.
Figure 2:
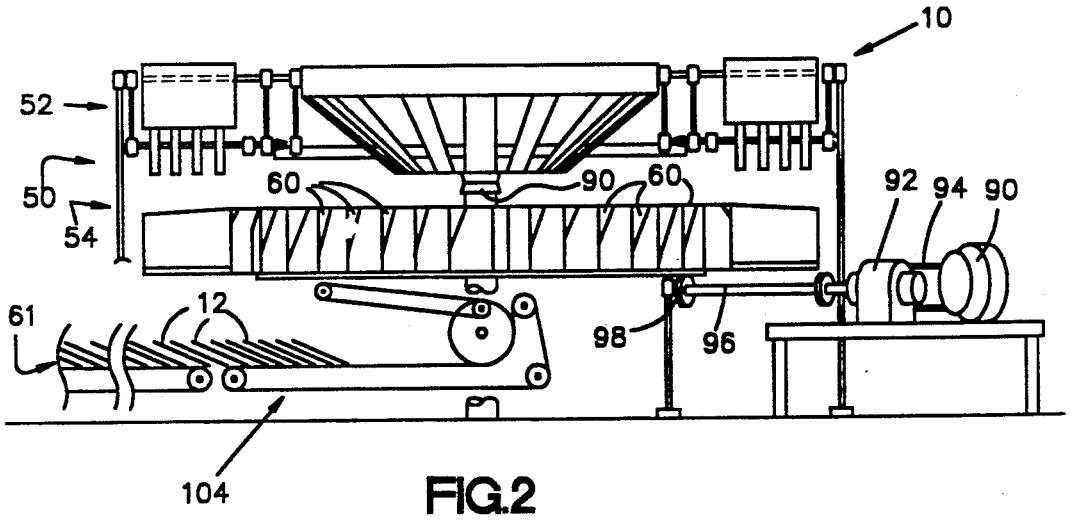
FIG. 2 is an elevational view, taken generally along the line 2—2 of FIG. 1, illustrating the relationship between inner section feed mechanisms, a rotor having bottom opening pockets, and a delivery conveyor assembly.
Figure 3:
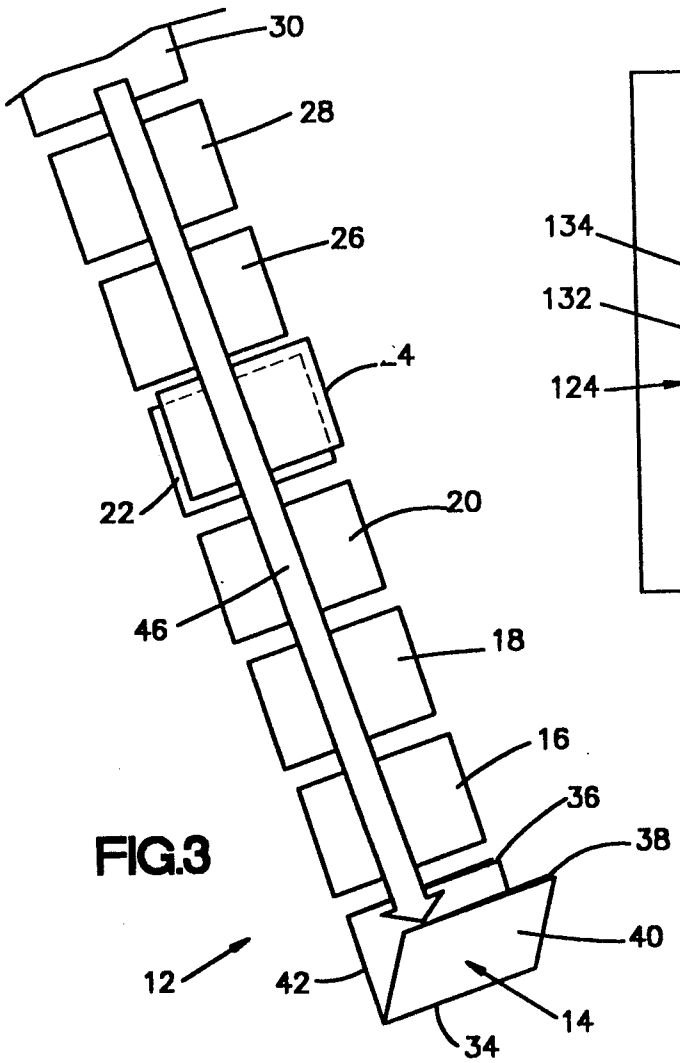
FIG. 3 is a schematic illustration depicting the manner in which inner sections are fed into a jacket section by the sheet material handling apparatus of FIGS. 1 and 2.

A sheet material handling apparatus 10 (FIGS. 1 and 2) is operable to form sheet material assemblages 12 (FIGS. 2 and 3). Each of the sheet material assemblages 12 includes a jacket or folded outer cover section 14 (FIG. 3) which encloses a plurality of inner sections 16, 18, 20, 22, 24, 26, 28 and 30. Although the sheet material assemblages 12 could take many different forms, for example, a booklet or group of signatures, the sheet material assemblages 12 are newspapers.

The jacket section 14 has a folded or closed edge portion 34 (FIG. 3) and a pair of cut or open edge portions 36 and 38. A headline side 40 of the jacket section 14 extends between the folded edge portion 34 and the open or cut edge portion 38. Similarly, a back side 42 extends between the closed or folded edge portion 34 and the other cut or open edge portion 36.

During operation of the sheet material handling apparatus 10 of FIGS. 1 and 2, the inner sections 16–30 are inserted into an open jacket 14 in the manner indicated schematically by an arrow 46 in FIG. 3. The sheet material handling apparatus 10 (FIGS. 1 and 2) includes a collating conveyor assembly 50 having a stationary circular infeed section 52. The infeed section 52 is disposed directly above and in a coaxial relationship with a movable circular rotor or collating conveyor section 54 having a plurality of collating spaces or pockets 60. The pockets 60 are bottom opening to enable sheet material assemblages or newspapers 12 to be transferred to a delivery conveyor assembly 61.

The infeed section 52 includes a jacket feed mechanism 64 (FIG. 1) which feeds jacket sections 14 one at a time into each of the pockets 60 in turn. The jacket feed mechanism 64 includes a hopper 66 for holding single stack of the jacket sections 14. The jacket sections 14 are sequentially fed from the stationary hopper 66 into the moving pockets 60 of the circular rotor 54 by a jacket feed assembly 68. The jacket sections 14 are received in the pockets 60 in upwardly opening orientation with the folded edge 34 down and the cut edges 36 and 38 spaced apart in a manner similar to that illustrated in FIGS. 3 and 4.

As the rotor 54 moves the pockets 60 in a counterclockwise direction (as viewed in FIG. 1) about a vertical central axis, the pockets 60 sequentially pass through a plurality of feed stations 72, 74, 76, 78, 80, 82, and 84. The feed stations 72–84 all have the same arcuate extent about the common vertical central axis of the rotor 54 and in-feed mechanism 52. As the pockets 60 move through each of the feed stations 72–84 in turn, the inner sections 16–30 are sequentially fed into the jacket sections.

A drive mechanism 88 rotates the rotor 54 at a constant speed about a vertical centerpost 90 (FIG. 2). Therefore, the pockets 60 sequentially move along a circular path through the feed stations 72–84 at a constant speed. The drive assembly 88 includes a motor 90 which is connected with a speed reducer 92 by a belt 94. During operation of the motor 90, a horizontal drive shaft 96 rotates a pinion gear 98 disposed in meshing engagement with a ring gear 100 fixedly connected with the rotor 54. Rotation of the pinion gear 98 rotates the rotor 54 in a counterclockwise direction as viewed in FIG. 1.

As each of the pockets 60 moves through a discharge station 104 (FIGS. 1 and 2), a control cam mechanism effects movement between opposite sides of the pocket to open the lower end of the pocket. As a pocket 60 opens, a sheet material assemblage or newspaper 12 is dropped from the pocket downwardly onto the delivery conveyor 61.

The construction of the collator conveyor assembly 50 is generally the same as is disclosed in U.S. Pat. No. 2,461,573. The construction of the delivery conveyor assembly 61 is generally similar to that disclosed in U.S. Pat. No. 4,479,643. However, it should be understood that it may be preferred to use a different type of delivery conveyor assembly 61. It is contemplated that it may be preferred to use a delivery conveyor assembly which includes a plurality of grippers which are interconnected by a conveyor chain and are moved in a continuous loop from the discharge station 104 to a receiving station in a manner similar to that disclosed in U.S. patent application Ser. No. 866,697, filed May 27, 1986 and entitled "Sheet Material Handling Apparatus".

In accordance with a feature of the present invention, the infeed section 52 is operable to feed inner sections 16, 18, 20, 26, 28 and 30 (FIGS. 1 and 3) one at a time into each jacket section 14 in turn and to feed a plurality of inner sections 22 and 24 at a time into each jacket section 14 in turn. Thus, at the feed stations 72, 74, 76, 80, 82 and 84 (FIG. 1), inner sections 16, 18, 20, 26, 28 and 30 are fed one at a time into jacket sections 14 by single inner section feed mechanisms 110. At the feed station 78, a plural inner section feed mechanism 114 is operable to feed an inner section 22 and an inner section 24 at the same time into a jacket section 14. The manner in which the inner sections 22 and 24 are fed at the same time into a jacket section 14 has been indicated schematically in FIG. 3 by having the inner sections 22 and 24 in a side-by-side relationship.

The plural inner section feed station 78 has the same arcuate extent as the single inner section feed stations 72, 74, 76, 80, 82 and 84. However, the number of inner sections fed at the feed station 78 is twice as great as the number of inner sections fed at the feed stations 72, 74, 76, 80, 82 and 84. By feeding a plurality of inner sections 22 and 24 into each of the jackets 14 in turn at the feed station 78, the capacity of the sheet material handling apparatus 10 is increased without increasing the size of the apparatus.

Figure 4:
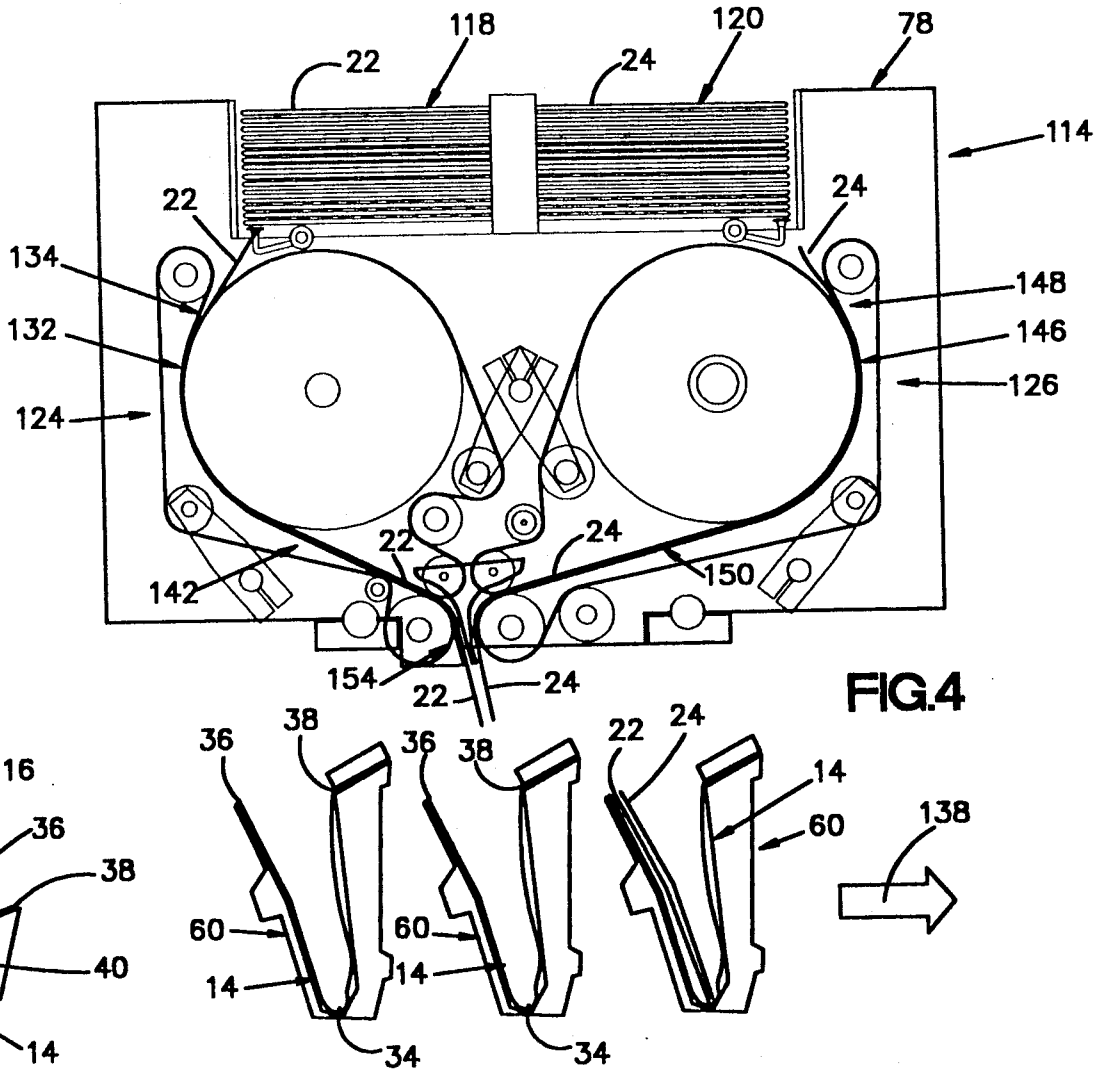
FIG. 4 is an illustration, taken generally along the line 4—4 of FIG. 1, depicting the manner in which a plurality of inner sections are fed at a time into a jacket section in each of the pockets in turn.

The manner in which a plurality of inner sections 22 and 24 are fed at a time into a jacket section 14 in each of the pockets 60 at the feed station 78 is illustrated in FIG. 4. Thus, the plural inner section feed mechanism 114 holds a stack 118 of inner sections 22 and a stack 120 of inner sections 24 with the two stacks disposed in a side-by-side relationship at the feed station 78. A first or left (as viewed in FIG. 4) feed mechanism 124 is operable to sequentially feed inner sections 22 from the stack 118 to pockets 60 as they move through the feed station 78. Similarly, a second or right (as viewed in FIG. 4) feed mechanism 126 is operable to sequentially feed inner sections 24 from the stack 120 to the pocket 60 as they move through the feed station 78.

The operation of the two feed mechanisms 124 and 126 is coordinated in such a manner that a pair of inner sections 22 and 24 are simultaneously fed into each of the jackets 14 in turn. The feeding of an inner section 24 from the stack 120 is started slightly ahead of the start of feed of an inner section 22 from the stack 118. This enables the inner sections 22 and 24 to be simultaneously fed into a jacket section 14 even though the path of movement of an inner section 22 from the stack 118 to a pocket 60 is slightly shorter than the path of movement of an inner section 24 from the stack 120 to the same pocket.

The feed mechanism 124 for the stack 118 moves each of the inner sections 22 along a path 132 which extends downwardly from the stack 118 to a pocket 60. The path 132 has a first or upper portion 134 which slopes downwardly from the stack 118 in a direction opposite to the direction of movement of the pockets 60 through the feed station 78. The pockets 60 move through the feed station 78 from left to right (as viewed in FIG. 4) in the direction of an arrow 138. The first portion 134 of the path 132 slopes downwardly and toward the left (as viewed in FIG. 4). Therefore, during movement of an inner section 22 along the first portion 134 of the path 132, the inner section moves in a direction opposite to the direction of movement of the pockets 60 through the feed station 78.

A second or lower portion 142 of the path 132 along which inner sections 22 are fed from the stack 118, slopes downwardly in the same direction as the movement of the pockets 60 through the feed station 78. Thus, the second portion 142 of the path 132 slopes downwardly and toward the right as viewed in FIG. 4, that is, in the direction of the arrow 138. Therefore, during movement of an inner section 22 along the second portion 142 of the path 132, the inner section moves in a direction which is the same as the direction of movement of the pockets 60 through the feed station 78.

The inner sections 24 are sequentially fed from the stack 120 to the pockets 60 along a path 146 by the feed mechanism 126. A first or upper portion 148 of the path 146 slopes downwardly from the stack 124 in the same direction as the direction of movement of the pockets 60 through the feed station 78, that is, toward the right as viewed in FIG. 4. Thus, the feed mechanism 126 moves each inner section 24 in turn downwardly and rightwardly from the stack 120. Therefore, during movement of an inner section 24 along the first portion 148 of the path 146, the inner section moves in a direction which is the same as the direction of movement of the pockets 60 through the feed station 78.

The path 146 along which the inner sections 24 from the stack 120 move has a second or lower portion 150 which slopes downwardly in a direction opposite to the direction of movement of the pockets 60 through the feed station 78. Thus, the second portion 150 of the path 146 slopes downwardly and toward the left as viewed in FIG. 4. Therefore, during movement of an inner section 24 along the second portion 150 of the path 146, the inner section moves in a direction which is opposite to the direction of movement of the pockets 60 through the feed station 78.

It should be understood that for purposes of clarity of illustration, the jacket sections 14 have been illustrated in FIG. 4 as being empty when they move into the feed station 78 and as containing only the inner sections 22 and 24 when they leave the feed station. However, when the pockets 60 reach the feed station 78, they will already have been moved through the feed stations 72, 74 and 76 and inner sections 16, 18 and 20 will have been inserted into the jackets 14. After the pockets 60 leave the feed station 78, they pass through the feed stations 80, 82 and 84 and inner sections 26, 28 and 30 are inserted into the jackets 14.

Although the sheet material handling apparatus 10 has been illustrated in FIG. 1 with the plural inner section feed mechanism 114 disposed downstream from the feed stations 72, 74 and 76 and upstream from the feed stations 80, 82 and 84, it is contemplated that the plural inner section feed mechanism 114 could have a different location in the sheet material handling apparatus 10. Thus, the plural inner section feed mechanism 114 could be located at the first feed station 72 or at the last feed station 84. In addition, more than one plural inner section feed mechanism 114 could be provided in the sheet material handling apparatus 10. The sheet material handling apparatus 10 can be modified in this manner since the feed stations 72–84 all have the same arcuate extent and are all large enough to accommodate the plural inner section feed mechanism 114.

The plural inner section feed mechanism 114 includes a pair of feed drums 160 and 162 (FIG. 5) which rotate in opposite directions about parallel horizontal axes. Thus, the feed drum 160 rotates in a counterclockwise direction as viewed in FIG. 5, while the feed drum 162 rotates in a clockwise direction. An inner feed belt 166 extends around the feed drum 160 and a drive roll 168. The feed belt 166 also extends around an idler roll 170 at the discharge station 154 and around a tensioning roll 172.

An outer feed belt 176 cooperates with the inner drive belt 166 to move an inner section 22 from the stack 118 along the path 132 to the discharge section 154. The outer feed belt 176 cooperates with a portion of the inner drive belt 166 which extends around the main drum 160 to grip an inner section 22. In addition, the outer feed belt 176 extends around a drive roll 180 and a roll 182 at the discharge station 154. The outer feed belt 176 also engages an idler roll 184 and a tensioning roll 186.

A feed sucker 190 is operable to grip a lower inner section 22 in the stack 118 and to move the gripped inner section to a nip 192 formed between the inner and outer feed belts 166 and 176. The feed belts 166 and 176 cooperate to move an inner section 122 along the periphery of the drum 160 to the discharge station 154. At the discharge station 154, the inner section 22 is engaged by guide member 194. The guide member 194 deflects the inner section 22 downwardly toward a jacket section 14 disposed in a pocket 60 moving through the feed station 78 (see FIG. 4).

The inner sections 24 from the stack 120 are fed downwardly to the discharge section 154 in the same manner as are the inner sections 22 from the stack 118. Thus, an inner feed belt 200 (FIG. 5) extends around the drum 162 and is driven by a drive roll 202. The belt 162 also extends around an idler roll 204 and around a tensioning roll 206.

A second or outer feed belt 210 cooperates with the inner feed belt 200 to sequentially grip the inner sections 24 and feed them downwardly to the discharge section 154. The outer feed belt 210 extends around a drive roll 212 and a roll 214 at the discharge station 154. The outer feed belt 210 also engages an idler roll 216 and a tensioning roll 218.

A sucker or feed member 222 is operable to feed inner sections 24 from the stack 120 to a nip 224 formed between the inner and outer feed belts 200 and 210. The feed belts 200 and 210 cooperate to positively feed an inner section 24 to the discharge station 154. At the discharge station 154, each inner section 24 in turn engages the guide member 194 and is deflected downwardly into an open jacket section 14 in a pocket 60 which is moving through the feed station 78 in the manner illustrated in FIG. 4. The deflector member 194 extends between the two paths 132 and 146 followed by the inner sections 22 and 24 to the discharge station 154. This enables the deflector member 194 to direct inner sections 22 following the path 132 and inner sections 24 following the path 146 into open jacket sections 14 in pockets 60 moving through the feed station 78.

Figure 5:
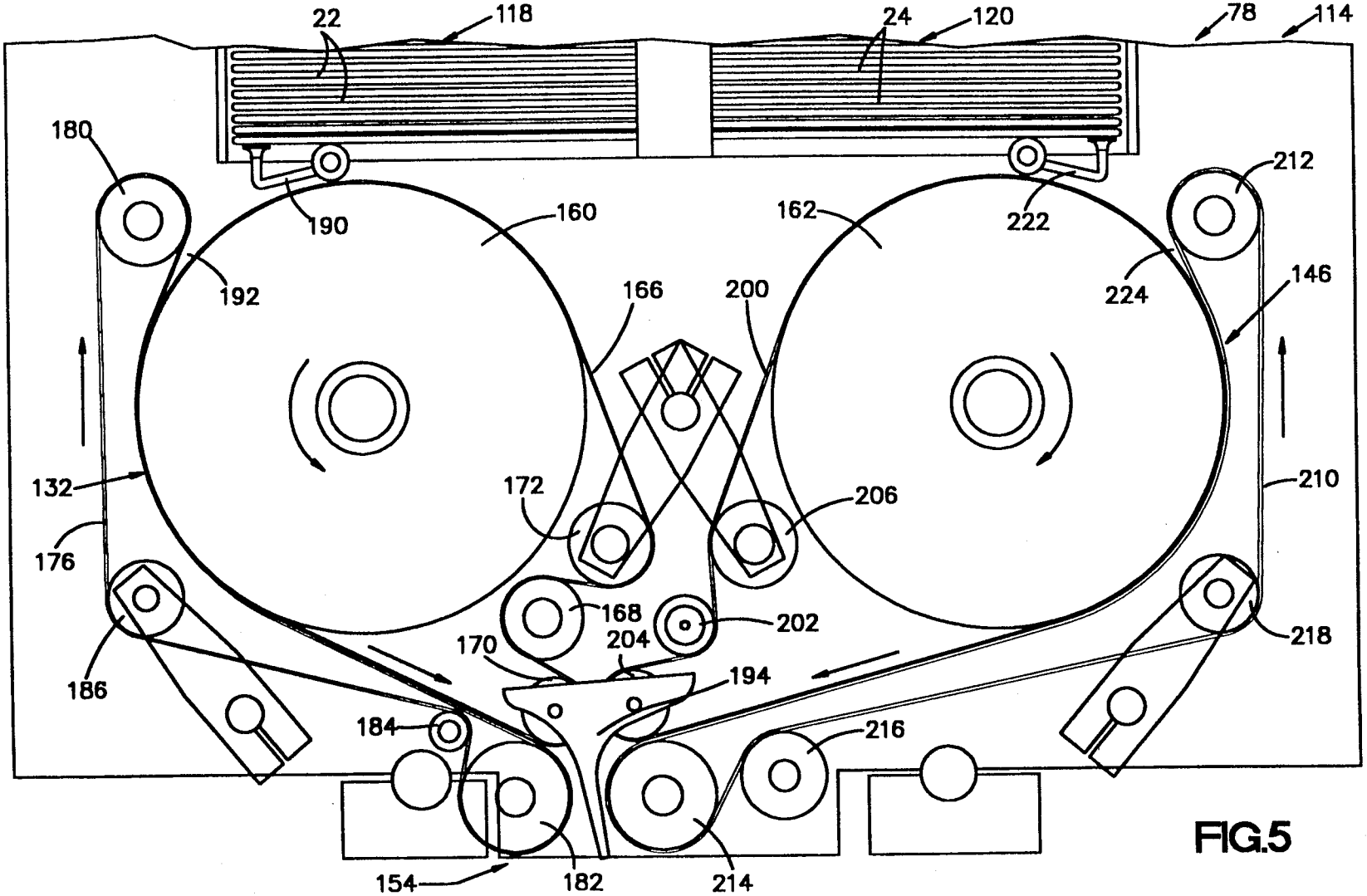
FIG. 5 is an enlarged elevational view of the feed mechanism of FIG. 4.

In the embodiment of the plural inner section feed mechanism 114 illustrated in FIG. 5, the inner sections 22 and 24 are fed into the nips 192 and 224 between the belts 166 and 200 by the feed suckers or members 190 and 222. However, it is contemplated that the counter rotating drums 160 and 162 could be provided with grippers to positively engage the leading or folded edge portion of the inner sections 22 and 24, if desired. If this were done, the grippers would move the inner sections 22 and 24 into the nips 192 and 224 between the belts 200 and 166 and would maintain their grip on the inner sections until they had been positively engaged by the belts. The grippers would then release the inner sections 22 and 24 before paths 132 and 146 along which the inner sections 22 and 24 are moved diverge from the periphery of the drums 160 and 162.

The stacks 118 and 120 of inner sections 22 and 24 are disposed with the major side surfaces of the inner sections 22 and 24 horizontal. However, it is contemplated that the inner sections 22 and 24 could be disposed in stacks with their major side surfaces vertical. Of course, if this was done, the plural inner section feed mechanism 114 would have to be constructed in such a manner so as to feed the inner sections 22 and 24 from stacks in which the major side surfaces of the inner section are disposed in a vertical orientation.

CONCLUSION

The present invention provides a new and improved method and apparatus 10 for forming sheet material assemblages 12 each of which has a jacket section 14 enclosing a plurality of inner sections 16–30. To form each sheet material assemblage 12, each pocket 60 in a circular array of pockets is sequentially moved through each feed station 72-84 in an arcuate array of feed stations. At feed stations 72, 74, 76, 80, 82 and 84, inner sections 16, 18, 20, 26, 28 and 30 are fed one at a time into a jacket section 14 in each of the pockets in turn. At the feed station 78, a plurality of inner sections 22 and 24 are fed at a time into a jacket section 14 in each of the pockets 60 in turn. By feeding a plurality of inner sections 22 and 24 at a time into a jacket section 16 at one of the feed stations 78, the number of inner sections 16–30 which can be fed into each jacket section 14 can exceed the number of feed stations 72–84.

Having described one specific preferred embodiment of the invention, the following is claimed:

1. An apparatus for use in forming sheet material assemblages having a jacket section enclosing a plurality of inner sections, said apparatus comprising a plurality of feed stations, an array of pockets, means for sequentially moving each pocket in said array of pockets through each of the feed stations, jacket feed means at one of the feed stations for feeding a jacket section into each of said pockets in turn with a major side surface of each jacket section extending transversely to the path of movement of said pockets, a plurality of single inner section feed means each of which is operable to feed inner sections one at a time into a jacket section in each of said pockets in turn with a major side surface of each inner section extending transversely to the path of movement of said pockets, each of said single inner section feed means being disposed at one of said feed stations, and plural inner section feed means disposed at one of said feed stations for feeding a plurality of inner sections at a time into a jacket section in each of said pockets in turn with major side surfaces of the plural inner sections extending transversely to the path of movement of said pockets, said plural inner section feed means including means for holding a first stack of inner sections, means for holding a second stack of inner sections, first transfer means for sequentially moving inner sections along a path at least a portion of which slopes downwardly from the first stack of inner sections in a direction opposite to the direction of movement of said pockets through the feed station at which said plural inner section feed means is disposed, and second transfer means for sequentially moving inner sections along a path at least a portion of which slopes downwardly from the second stack of inner sections in the same direction as the direction of movement of said pockets through the feed station at which said plural inner section feed means is disposed, each of the feed stations at which one of said single inner section feed means is disposed and the feed station at which said plural inner section feed means is disposed all having the same extent along a path of movement of said pockets.

2. An apparatus as set forth in claim 1 wherein said plural inner section feed means includes discharge means extending between the paths which slope downwardly from the first and second stacks of inner sections for receiving inner sections from the first and second stacks of inner sections and for simultaneously directing inner sections from the first and second stacks of inner sections into a jacket section in each of said pockets in turn.

3. An apparatus as set forth in claim 1 wherein each of said pockets has an upper end portion and a lower end portion which is operable between open and closed conditions, said single inner section feed means and said plural inner section feed means including means for sequentially feeding inner sections into said pockets with the lower end portions of said pockets in the closed condition, said apparatus further including means for sequentially operating the lower end portions of said pockets from the closed condition to the open condition to sequentially release sheet material assemblages which include a jacket section enclosing a plurality of inner sections.

4. An apparatus as set forth in claim 1 wherein said plurality of feed stations are disposed in an arcuate array and said pockets are disposed in a circular array, said means for sequentially moving each pocket through each of the feed stations including means for moving said pockets along a circular path.

5. An apparatus for use in forming sheet material assemblages having a jacket section enclosing a plurality of inner sections, said apparatus comprising a plurality of feed stations disposed in an arcuate array, a circular array of pockets, means for sequentially moving each pocket in said circular array of pockets through each of the feed stations, jacket feed means at one of the feed stations for feeding a jacket section into each of said pockets in turn with a major side surface of each jacket section transverse to the path of movement of said pockets, a plurality of single inner section feed means each of which is operable to feed inner sections one at a time into a jacket section in each of said pockets in turn with a major side surface of each inner section transverse to the path of movement of said pockets, each of said single inner section feed means being disposed at one of said feed stations, and plural inner section feed means disposed at least at one of said feed stations for feeding a plurality of inner sections at a time into side-by-side engagement with each other in a jacket section in each of said pockets in turn with major side surfaces of the plurality of inner sections transverse to the path of movement of said pockets, each of the feed stations at which one of said single inner section feed means is disposed and the feed station at which said plural inner section feed means is disposed having the same arcuate extent in the arcuate array of feed stations, aid plural inner section feed means includes means for holding a first stack of inner sections, means for holding a second stack of inner sections, first transfer means for sequentially moving inner sections along a path at least a portion of which slopes downwardly from the first stack of inner sections in a direction opposite to the direction of movement of said pockets through the feed station at which said plural inner section feed means is disposed, and second transfer means for sequentially moving inner sections along a path at least a portion of which slopes downwardly from the second stack of inner sections in the same direction as the direction of movement of said pockets through the feed station at which said plural inner section feed means is disposed.

6. An apparatus for use in forming sheet material assemblages having a jacket section enclosing a plurality of inner sections, said apparatus comprising a plurality of feed stations disposed in an arcuate array, a circular array of pockets, means for sequentially moving each pocket in said circular array of pockets through each of the feed stations, jacket feed means at one of the feed stations for feeding a jacket section into each of said pockets in turn with a major side surface of each jacket section transverse to the path of movement of said pockets, a plurality of single inner section feed means each of which is operable to feed inner sections one at a time into a jacket section in each of said pockets in turn with a major side surface of each inner section transverse to the path of movement of said pockets, each of said single inner section feed means being disposed at one of said feed stations, and plural inner section feed means disposed at least at one of said feed stations for feeding a plurality of inner sections at a time into side-by-side engagement with each other in a jacket section in each of said pockets in turn with major side surfaces of the plurality of inner sections transverse to the path of movement of said pockets, each of the feed stations at which one of said single inner section feed means is disposed and the feed station at which said plural inner section feed means is disposed having the same arcuate extent in the arcuate array of feed stations, said plural inner section feed means includes means for holding a first stack of inner sections, and first transfer means for sequentially moving inner sections along a first path having a first portion which slopes downwardly from the first stack of inner sections in a direction opposite to the direction of movement of said pockets through the feed station at which said plural inner section feed means is disposed and a second portion which slopes downwardly and in the same direction as the direction of movement of said pockets through the feed station at which said plural inner section feed means is disposed, said plural inner section feed means includes means for holding a second stack of inner sections, and second transfer means for sequentially moving inner sections along a second path having a first portion which slopes downwardly from the second stack of inner sections in the same direction as the direction of movement of said pockets through the feed station at which said plural inner section feed means is disposed and a second portion which slopes downwardly in a direction opposite to the direction of movement of said pockets through the feed station at which said plural inner section feed means is disposed.

7. An apparatus as set forth in claim 6 wherein said plural inner section feed means includes discharge means extending between the second portions of said first and second paths for receiving inner sections from the first and second stacks of inner sections and for simultaneously directing inner sections from the first and second stacks of inner sections into a jacket section in each of said pockets in turn.

8. A method of forming a sheet material assemblage having a jacket section enclosing a plurality of inner sections, said method comprising the steps of sequentially moving each pocket of an array of pockets through each feed station in an array of feed stations, feeding a jacket section into each of the moving pockets in turn at one of the feed stations, thereafter, feeding inner sections one at a time into a jacket section in each of the moving pockets in turn at each of a plurality of the feed stations, and feeding a plurality of inner sections at a time into a jacket section in each of the moving pockets in turn at one of the feed stations, said step of feeding a plurality of inner sections at a time into a jacket section in each of the moving pockets in turn at one of the feed stations including sequentially moving inner sections along a first path which slopes downwardly from a first stack of inner sections and sequentially moving inner sections along a second path which slopes downwardly from a second stack of inner sections, said step of moving each pocket of an array of pockets including moving each pocket in turn away from the one feed station where plurality of inner sections are fed at a time with major side surfaces of the inner sections which were fed at the one feed station disposed in side-by-side engagement with each other and extending transversely to the path of movement of the pockets, said step of moving each pocket through each feed station in the array of feed stations including moving each pocket through the same distance at each feed station where inner sections are fed one at a time into a jacket section and at the one feed station where a plurality of inner sections are fed at a time into a jacket section, said step of moving inner sections along a first path includes moving the inner sections in a direction opposite to the direction of movement of the pockets through the one feed station, said step of moving inner sections along a second path includes moving inner sections in the same direction as the direction of movement of the pockets through the one feed station.

* * * * *

UNITED STATES PATENT AND TRADEMARK OFFICE

CERTIFICATE OF CORRECTION

PATENT NO. : 5,082,256

DATED : January 21, 1992

INVENTOR(S) : Robert A. Bryson

It is certified that error appears in the above-identified patent and that said Letters Patent is hereby corrected as shown below:

Column 8, Line 26, Claim 5, change "aid" to --said--.

Signed and Sealed this

Twenty-seventh Day of April, 1993

*Attest:*

MICHAEL K. KIRK

*Attesting Officer*

*Acting Commissioner of Patents and Trademarks*